United States Patent [19]

Okada et al.

[11] Patent Number: 4,827,747

[45] Date of Patent: May 9, 1989

[54] METHOD FOR PRODUCING A BELLOWS WITH OVAL CROSS SECTION AND APPARATUS FOR CARRYING OUT THE METHOD

[75] Inventors: Kenichi Okada; Hiroshi Asao, both of Yokohama; Keiichi Nakamura, Tokyo, all of Japan

[73] Assignee: Hitachi, Ltd., Tokyo, Japan

[21] Appl. No.: 51,697

[22] Filed: May 20, 1987

[30] Foreign Application Priority Data

May 21, 1986 [JP] Japan ..... 61-114568
Apr. 15, 1987 [JP] Japan ..... 62-91015

[51] Int. Cl.[4] ..... B21D 15/06
[52] U.S. Cl. ..... 72/59; 72/370
[58] Field of Search ..... 72/57, 58, 59, 60, 61, 72/62, 385, 392, 370, 378, 416; 29/421 R

[56] References Cited

U.S. PATENT DOCUMENTS 3,091,280 5/1963 Yowell et al. ..... 72/59
3,625,040 12/1971 Gain ..... 72/59
3,704,983 12/1972 Tellot ..... 72/59
3,996,783 12/1976 Meserole ..... 72/392
4,275,579 6/1981 Anoshko et al. ..... 72/59
4,319,471 3/1982 Benteler et al. ..... 72/59
4,571,980 2/1986 Goodwin ..... 72/392

FOREIGN PATENT DOCUMENTS 95927 5/1986 Japan ..... 72/59
0086030 5/1986 Japan ..... 72/416

*Primary Examiner*—David Jones
*Attorney, Agent, or Firm*—Antonelli, Terry & Wands

[57] ABSTRACT

After a metallic cylindrical tube is bulged to form a bellows with a circular cross section, this bellows is ovalized to form a bellows with an oval cross section. For this reason, an inexpensive round tube (cylindrical tube) can be used as the material for a bellows with an oval cross section and it is unnecessary to use an expensive oval tube. Accordingly, a bellows with an oval cross section can be produced at low cost.

12 Claims, 8 Drawing Sheets

METHOD FOR PRODUCING A BELLOWS WITH OVAL CROSS SECTION AND APPARATUS FOR CARRYING OUT THE METHOD

BACKGROUND OF THE INVENTION

This invention relates to a method for producing a metallic bellows and an apparatus for carrying out the method. More specifically, this invention relates to a method for producing a metallic belows with a substantially oval cross-sectional shape and an apparatus for carrying out the method.

This bellows is used not only as a flexible joint and the like in fluid piping but, especially in a small size, as a cooling water passage for cooling a large-scale IC chip used in a large-scale computer and the like, which serves also as an elastic support for such chip.

In this specification, an "oval," "substantially oval," or "ovoidal" cross section includes not only a "mathematically or geometrically elliptical" shape but an "egg-shaped" configuration, and further includes also a profile at least one part of which, for example, the portion which is almost parallel to the major axis of an oval (hereinafter referred to as the "long side"), is linear. In this specification, noncircular ring forms are included in the term "oval" with the exception of polygonal shapes the vertexes or apexes of which are angular. In other words, a polygonal with all vertexes or apexes are rounded is included in the term "oval."

Also, in this specification, the term "bellows" means a tube whose side wall alternately provides ridges or large-diameter portions (bulged portions) and grooves or small-diameter portions (non-bulged portions). In a bellows, the cross-sectional size of all large-diameter portions may be the same or may not be the same, and that of all small-diameter portions also may be the same or may not be the same. Furthermore, the intervals of large-diameter portions may be the same or may vary in the longitudinal direction of the tube or bellows and those of small-diameter portions also may be the same or may vary in the longitudinal direction. Moreover, in a bellows, the cross-sectional shape of bulged portions may be or may not be substantially similar to that of nonbulged portions. The above-mentioned configurational conditions for a bellows can be selected conveniently depending on the elasticity, mechanical strength, etc. as in tension, compression and bending in various directions that the bellows is required to provide according to its application. When a bellows is used as a flexible joint in fluid piping and the like, the major or minor axis of the oval in the cross section of the bellows may be several millimeters to several centimeters or more in size. When a bellows is used as a cooling water passage or elastic support for a large-scale IC chip, the major or minor axis of the oval in the cross section of the bellows may be several millimeters or less in size.

Also, in this specification, the term "circular bellows" means a bellows with a circular cross-sectional shape and an "oval bellows" represents a bellows with a substantially oval or ovoidal cross section.

Furthermore, in this specification, "ovalizing" means transforming a cross-sectional form into an oval form.

Hitherto, bellows with an oval cross section have been produced, for example, as described in Japanese Patent Laid-Open No. 95927/86, from stock tubes with an oval cross section by means of a forming die that has protuberances formed in part of the semi-oval so that the portions of the ridges of the oval bellows to be formed which are virtually parallel to the major axis may be generally linear.

In this method of the prior art, however, expensive oval stock tubes are required and this may result in high production costs of oval bellows. Moreover, in the method disclosed in Japanese Patent Laid-Open No. 95927/86, the above-mentioned protuberances provided in the forming die cause a decrease in the cross section of the fluid passage at parts of the formed article including the inwardly protruded portions corresponding to the above-mentioned protuberances and no attention has so far been paid to this point. The inwardly protruded portions may also affect the fluid flow in the passage of the bellows to be disturbed.

Furthermore, when folding is conducted to form a bellows by axially applying compressive loads to the bulged part, the circumferentially non-uniform strain or deformation is caused to results in the circumferentially non-uniform stress remained in the bellows due to the inwardly protruded portions circumferentially locally formed in the grooves of the bulged part corresponding to the above-mentioned protuberances (which are formed in portions almost parallel to the major axis of the oval in terms of the cross section of the bulged part). Therefore, there is fear that the bellows thus produced is likely to be broken after repeated deformation in use.

When a stock tube with an oval cross section is bulged to form bulged portions as in this prior art and when the forming die is not provided with the protuberances disclosed in Japanese Patent Laid-Open No. 95927/86, portions of small curvature (i.e., large radius of curvature) that are virtually parallel to the major axis of the oval are radially bulged more than portions of large curvature that are virtually parallel to the minor axis upon bulging because of the oval shape of the cross section of the tube. The higher the ratio of the major axis to the minor axis of an oval, the greater the difference in the degree of this bulging. When a bellows is to be formed by axially applying compressive forces to a tube with bulged portions whose degree of bulging thus differs radially and by folding the bulged and nonbulged portions, buckling may occur in the portions of low degree of bulging (a case where the bulged amount is too small in the above-mentioned portions of large curvature) or excessive tensile deformation may occur in the portions of small degree of bulging (a case where the bulged amount becomes too large when an attempt is made to increase the bulged amount in the above-mentioned portions of large curvature). Therefore, necking or ductile fracture may occur in these portions.

SUMMARY OF THE INVENTION

This invention was made in view of the abovementioned various problems and an object of the invention is to provide a method for producing a bellows with a substantially oval cross section directly from an inexpensive cylindrical tube by means of a single apparatus.

According to the present invention, the above-mentioned object is achieved by a method for producing a bellows with an oval cross section that comprises a step of bulging a metallic cylindrical tube to form a bellows with a circular cross section and a step of ovalizing the bellows with a circular cross section to form the bellows with the oval cross section.

In a method according to a preferred embodiment of the present invention, the above-mentioned step of ovalizing comprises upsetting of the bellows with the circular cross section using a pair of dies for pressure application by applying upsetting forces to the circular bellows in the radial direction of its circle.

In this case, hydraulic pressure is preferably applied to the inside of the circular bellows beforehand for the upsetting.

In the method of this embodiment, the pair of dies for pressure application installed on the hydraulic forming device are caused to operate to radially upset the circular bellows hydraulically bulged by sectional dies after the separation of these sectional dies. In this way, a circular bellows can be formed into a bellows with an oval cross section by means of the same apparatus as the hydraulic forming device and in a small number of processing steps or short man-hours for forming. Accordingly, a bellows with an oval cross section can be produced in a simple manner and at low cost, with the result that the production cost can be reduced.

In another preferred embodiment of the present invention, the above-mentioned step of ovalizing comprises stretch-forming of the bellows with the circular cross section using a pair of stretching dies by applying tensile forces to the circular bellows in the radial direction of its circle.

In the method of this embodiment of the present invention, an oval bellows with a cross section of an oval and the like can be produced without using an expensive oval stock tube. A bellows with a circular cross section is first formed from an inexpensive circular stock tube, two stretching dies having similar corrugations with the corrugations inside the circular bellows are then inserted in the circular bellows, which is then stretched by these stretching dies. This forming process enables an oval bellows with the desired oval cross section to be easily produced.

In this case, since the ovalizing is conducted by the stretch forming, the fluid passage area of a shaped article or oval bellows does not decrease.

According to the present invention, in any of the above-mentioned cases, the bulging is preferably conducted by applying fluid pressure to the inside of the cylindrical tube. In this case, the fluid for pressure application is preferably a liquid.

According to the present invention, the above-mentioned step of forming the circular bellows preferably includes a step of axially deforming a bulged metallic tube under pressing pressure so that the bulged portions of the tube are folded.

Also, according to an embodiment of the present invention, the above-mentioned step of forming the bellows with the cricular cross section comprises placing two sets of sectional forming dies which cooperatively define a circular shape by inside surfaces thereof, each set consisting of halves of sectional dies, to the outside of the metallic cylindrical tube in a manner that sectional forming dies in each set are spaced by a specified distance from each other in the axial direction of the tube, bulging the metallic cylindrical tube by applying hydraulic pressure to an inside of the metallic tube, and axially pressing the metallic tube to form the bellows with the circular cross section.

According to the above-mentioned embodiment of the present invention, the circular bellows is formed by means of a bulge forming die, which comprises the two sets of sectional half-dies, and each of sectional die comprises a forming part which has an inside diameter almost equal to an outside diameter of the cylindrical tube and a same shape of inside surface as one of the grooves of the circular bellows to be formed, and a base integrated with this forming part and of a larger thickness than the forming part. When each sets of sectional half-dies are superimposed on each other, the thickness center distance of the forming parts becomes equal to the pitch of the bellows with the circular cross section.

Incidentally, when elastic recovery occurs to some degree due to spring-back after the formation of a circular bellows, a die in which this elastic recovery is taken into account, i.e., a forming die with a smaller pitch may be used. The shape of the ridges and grooves of a bellows as seen in the section along the axis of the bellows can be selected or determined depending on the mechanical properties required of the bellows.

In the case of the above-mentioned another preferred embodiment of the present invention, for example, the above-mentioned step of ovalizing comprises relieving hydraulic pressure from inside the bellows with the circular cross section, removing the sectional dies, inserting two stretching dies in the circular bellows in a manner that the two stretching dies are fitted to the ridges and grooves of the circular bellows and are opposed to each other, and stretching the two stretching dies by a specified distance in the directions in which the two are separated from each other, thereby elongating the circular bellows to form the bellows with the oval cross section.

In this case, for example, ovalizing is conducted by means of stretching dies which have the same external form as an internal form at the ends on the major axis of the oval of the bellows with the oval cross section to be formed and provide corrugations capable of being fitted to the ridges and grooves of the bellows with the circular cross section.

Another object of the present invention is to provide an apparatus for carrying out the above-mentioned method.

According to the present invention, this object is accomplished by an apparatus for producing a bellows with an oval cross section which comprises a first supporting mechanism having a pair of first supporting parts opposed to each other in a first direction and capable of approaching each other and moving away from each other so as to be able to support both ends of a metallic tubular body in a liquid-tight manner; a second supporting mechanism having a pair of second supporting parts capable of approaching each other and moving away from each other in a second direction orthogonal to the first direction; two sets of sectional dies supported by the second supporting parts so that the sectional dies can be brought into contact with opposed side walls of the metallic tube when the second supporting parts are moved so as to approach each other; a hydraulic pressure introducing mechanism for introducing hydraulic pressure into the metallic tube through at least one of the first supporting parts to conduct bulging of the metallic cylindrical tube while both ends of the metallic cylindrical tube are supported by the first supporting parts in the liquid-tight manner and the opposed side walls of the metallic cylindrical tube are kept in contact with the two sets of sectional dies, the sectional dies in each set being kept away from each other in the first direction; and a third supporting mechanism having a pair of third supporting parts capable of approaching each other and moving away from each other in the third direction orthogonal to the first and second directions and adapted to ensure that the cross-sectional shape of a circular bellows formed by the bulging is changed into oval by deforming opposed side walls of the bellows when the third supporting parts are caused to approach each other or move away from each other.

In a preferred embodiment of the present invention, each set of the sectional dies are supported by each of the second supporting parts in a manner that each set of the sectional dies can be moved relative to the corresponding second supporting part and relative to each other in the first direction, and the first supporting mechanism is adapted to press both ends of the metallic tube by means of the first supporting parts so that after the bulging the first supporting parts are caused to approach each other closer than during the bulging.

In an apparatus according to a preferred embodiment of the present invention, the third supporting parts of the third supporting mechanism comprise upsetting parts adapted to change the cross-sectional shape of the bellows from circular into oval by applying upsetting forces to the opposed side walls of the bellows when the third supporting parts are caused to approach each other. In this case, each of the upsetting parts preferably provides concavities receiving the protrusions of the circular bellows in the area where it is brought into contact with the opposed side wall or the external wall of the bellows. Furthermore, preferably both ends of the circular bellows are supported in a liquid-tight manner with the first supporting parts during the upsetting by the upsetting parts and hydraulic pressure is applied to the inside of the circular bellows by means of the hydraulic pressure introducing mechanism during the upsetting.

In an apparatus according to another embodiment of the present invention, the third supporting parts of the third supporting mechanism comprise stretching parts adapted to change the cross-sectional shape of the bellows from circular to oval by applying tensile forces to the opposed side walls of the bellows when the third supporting parts are caused to move away from each other.

In an apparatus according to the present invention in all of the foregoing cases, each of the first, second and third supporting mechanisms proper preferably comprises a cylinder means and the third direction is preferably the vertical direction.

These and other objects of the present invention and effects obtained therefrom will become clear from the following description with reference to the accompanying drawings, wherein.

DESCRIPTION OF THE PREFERRED EMBODIMENTS

The first embodiment of the present invention will be described hereinafter with reference to FIGS. 1 to 6.

Figure 1:
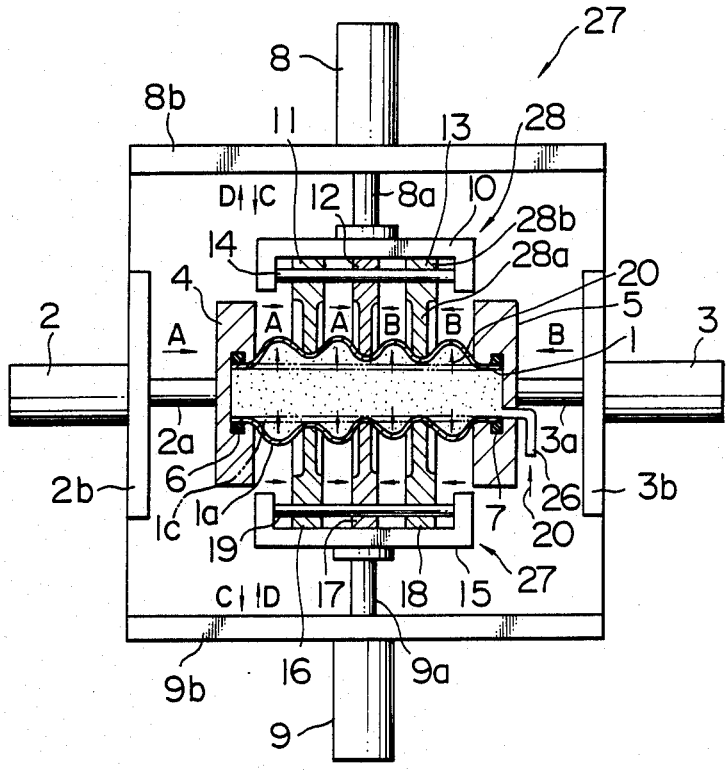
FIG. 1 is a plan sectional view of a common parts to apparatuses for carrying out the method for producing bellows in first and second preferred embodiments of the present invention in its state of bulging by hydraulic pressure.
Figure 2:
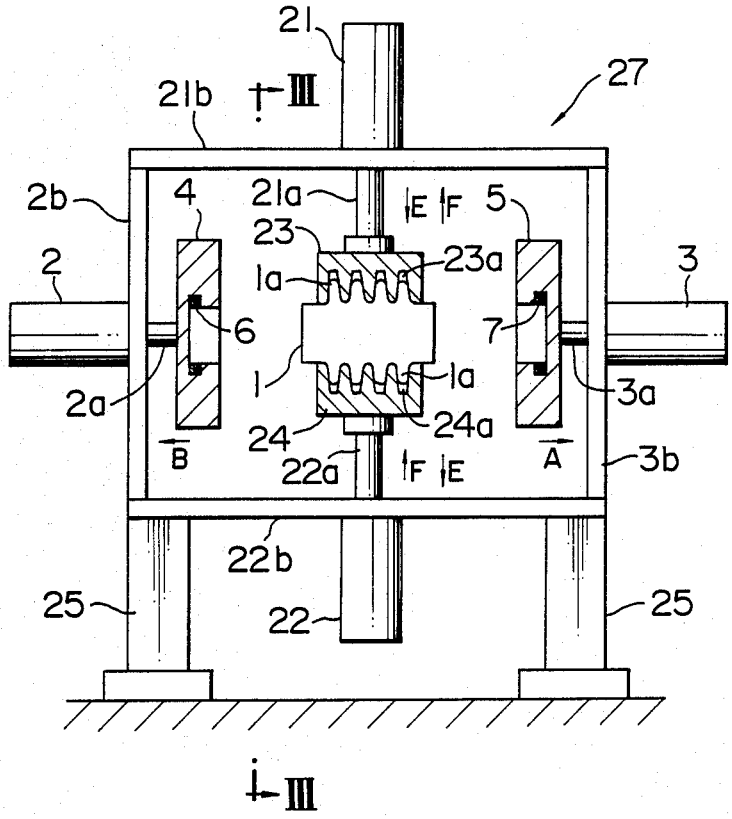
FIG. 2 is a front sectional view of the apparatus of FIG. 1, which illustrates the hydraulic pressure forming condition for the upsetting by an apparatus for carrying out the method for producing the oval bellows in the first preferred embodiment of the present invention.
Figure 3:
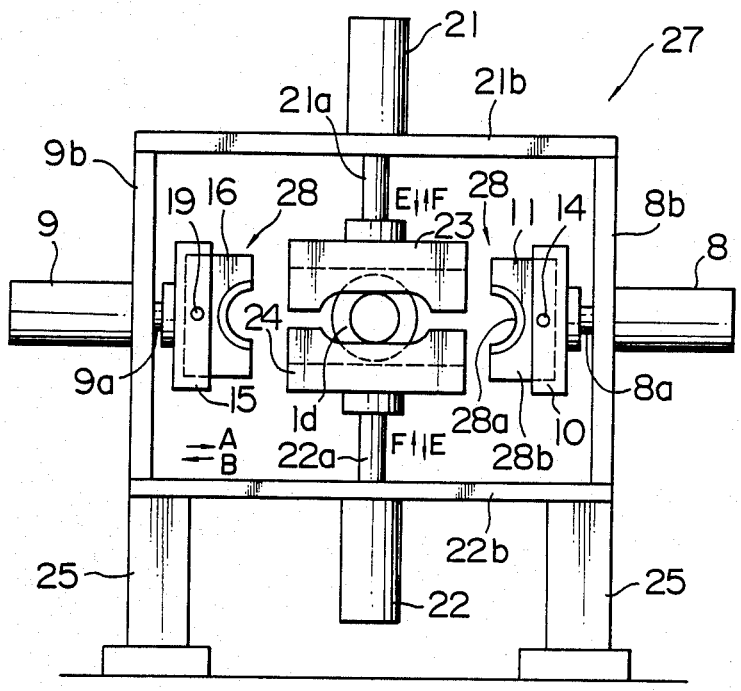
FIG. 3 is a sectional side view along line III—III of FIG. 2.
Figure 5:
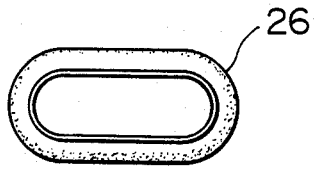
FIG. 5 is a plan view of an example of bellows produced in accordance with the present invention.
Figure 6:
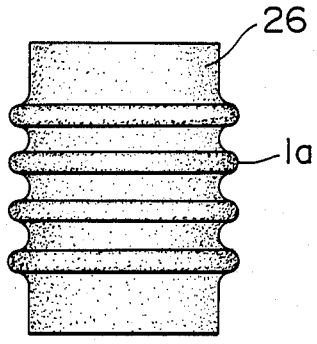
FIG. 6 is a front view of the bellows shown in FIG. 5.

Referring to FIGS. 1 to 3, the reference numeral 1 is a stock tube for producing an oval bellows 26 (shown in FIGS. 5 and 6). The stock tube 1 is made of a metal, such as copper and its alloys, and initially has a circular cross section, as represented by the imaginary lines in FIG. 1.

A forming die 28 used for forming this stock tube 1 into a circular bellows 1*d* (refer to FIG. 3) has the first to sixth sectional dies 11–13 and 16–18. These six sectional dies comprise two sets of sectional dies (one set 11–13 and another set 16–18), or three pairs of sectional half-die, i.e., a pair of the first and fourth sectional dies 11 and 16, a pair of the second and fifth sectional dies 12 and 17, and a pair of the third and sixth sectional dies 13 and 18. When integrated, sectional dies of each pair provide a forming part 28*a* which has an inside diameter almost equal to the outside diameter of the stock tube 1 and the same shape of inside surface as that of one of the grooves of the circular bellows, and a base 28*b* integral with the forming part 28*a* and thicker than the forming part 28*a*. When these sectional dies are moved axially, i.e., in the directions indicated by the arrows A and B and are superposed on each other, the thickness center distance of the forming parts 28*a* becomes equal to the pitch of the circular bellows 1*c*. The first to third sectional half-dies 11, 12, 13 on one side can be moved in the axial direction of the stock tube, i.e., in the directions A and B guided by a rod 14 attached to a sectional-die supporting member or plate 10. Similarly, the fourth to sixth sectional dies 16, 17, 18 on the other side can be moved in the axial direction of the stock tube, i.e., in the directions A and B guided by a rod 19 attached to a sectional-die supporting member or plate 15. The reference numerals 2 and 3 re the first cylinder and the second cylinder fixed to a mounting plate 2*b* and a mounting plate 3*b*, respectively, 2*a* and 2*b* represent rods of these cylinders 2 and 3, reference numeral 4 represents a seal holder which is attached to the end of the rod 2*a* and seals and supports one end of the stock tube 1 in conjunction with an inserted O-ring 6, and reference numeral 5 represents a seal holder which is attached to the end of the rod 3*a* and seals and supports the other end of the stock tube 1 in conjunction with an inserted O-ring 7. A pipe 26 for introducing hydraulic pressure into the inside of the stock tube 1 is attached to the seal holder 5. The seal holders 4 and 5 can compress the stock tube 1 axially, i.e., in the directions A and B when driven by the cylinders 2 and 3 while hydraulic pressure is applied to the inside of the tube 1.

The numerals 8 and 9 denote the third cylinder and the fourth cylinder attached to a mounting plate 8*b* and a mounting plate 9b, respectively, 8a and 9a are rods of these cylinders 8 and 9. The sectional-die supporting plates 10 and 15 are fixed to the ends of the rods 8a and 9a, respectively. When the cylinders 8 and 9 are actuated, the sectional dies 11 to 13 and 16 to 18 can be moved in the directions C and D in the course from the retreat position (FIG. 3) to the integration position (FIG. 1). In the integration position, closing loads can be applied to the sectional dies.

In FIGS. 2 and 3, an upper die for pressure application 23 and a lower die for pressure application 24 are adapted to radially upset the circular bellows 1d, which has been hydraulically formed by means of the first to sixth sectional dies 11–13 and 16–18, under the action of the fifth and sixth cylinders 21 and 22 to produce an oval bellows. The ridges la are inserted in the grooves 23a, 24a of upper and lower upsetting dies 23, 24, to prevent the deformation of the ridges 1a. The upper and lower dies for pressure application 23 and 24 are fixed to the ends of rods 21a and 21b, respectively, of the fifth and sixth cylinders 21 and 22 arranged in perpendicular to the extending directions of the third and fourth cylinders 23 and 24. The fifth and sixth cylinders 21 and 22 are fixed to mounting plates 21b and 22b, respectively.

A method for producing a bellows in this embodiment by the operation of the apparatus 27 for producing the bellows 26 thus constructed will be described in the following.

Referring to FIG. 1, all of the six sectional dies are moved to be arranged around the stock tube 1 in the following manner. Both ends of the stock tube 1 (1c) are first hydraulically sealed by means of the seal holders 4 and 5 through the advance of the rods 2a and 3a in the directions A and B, respectively, which is accomplished by the actuation of the first and second cylinders 2 and 3, respectively. After that, the first to third sectional dies 11–13 and the fourth to sixth sectional dies 16–18, which are spaced from each other by a specified distance, for example, a distance corresponding to the outer diameter of the stock tube 1 multiplied by about 0.4 to 0.6, are moved in the directions C and D, respectively, through the advance of the rods 8a and 9a in the directions C and D by the actuation of the third and fourth cylinders 8 and 9, respectively, whereby three pairs of sectional dies 11 and 16; 12 and 17; and 13 and 18 are closed. Next, by applying hydraulic pressure 20 to the inside of the stock tube 1 through the pipe 26, free bulging is accomplished between the seal holders 4 and 5 and the sectional dies 11–13 and 16–18 and the ridges 1a are formed (the step 30 in the flowchart of FIG. 4). With the hydraulic pressure 20 kept at a constant level, the sectional dies 11–13 and 16–18 are moved in the direction A or B to deform the ridges la through the advance of the rods 2a, 3a of the first and second cylinders 2, 3 so that the ridges la (and grooves) of the bulged stock tube are folded when the axial compressive loads are applied to the stock tube in the directions A and B (the step 31 in the flowchart). On this occasion, this folding or compression step is completed when the sectional dies 11–13 and 16–18 are integrated into one piece (the step 32 in the flowchart). Then the oil in the circular bellows or tube 1 is recovered after the relief of hydraulic pressure 20.

With the seal holders 4 and 5 stopped, the rods 8a and 9a of the third and fourth cylinders 8 and 9, respectively, are caused to retreat in the directions D and C, respectively, and the first to sixth sectional dies 11–13 and 16–18 are separated from the formed article 1d (the step 33 in the flowchart).

As shown in FIG. 2, the ridges 1a of the circular bellows are then inserted in the grooves 23a and 4a of the upper and lower dies for pressure application 3 and 24, respectively, by advancing, the rods 21a and 22a of the fifth and sixth cylinders 21 and 22, respectively, arranged in the directions E and F respectively, orthogonal or perpendicular to the extending direction of the third and fourth cylinders 8 and 9, and then the advancement of the rods 21a and 22a are stopped. The rods 2a and 3a of the first and second cylinders 2 and 3, respectively, are then caused to retreat in the directions B and A, respectively, and the seal holders 4 and 5 are extracted from both ends of the stock tube 1. After that, by further advancing the rods 21a and 22a of the fifth and sixth cylinders 21 and 22, respectively, in the directions E and F, respectively, the hydraulically formed circular bellows 1d is radially upset and is caused to undergo plastic deformation, whereby the circular bellows 1 is deformed or converted into an oval bellows 26. On this occasion, a bellows 26 whose portions extending almost in parallel to the major axis of the oval are linear can be produced by means of the upper and lower dies 23 and 24 whose surfaces for pressure application are flat, and an oval bellows in which the portions extending almost parallel to the major axis of the oval have a large curvature can be produced by means of dies whose surfaces 23, 24 are curved (the steps 34 and 35 in the flowchart). The appearance of a bellows 26 with linear long sides produced by the method for producing the oval bellows in this embodiment is shown in FIGS. 5 and 6.

Now the first embodiment of the present invention will be described in connection with the following examples:

EXAMPLE 1

Oval bellows in which the major and the minor axes of an oval at the outside the ridge were about 70 mm and about 45 mm, respectively, and which had four ridges at a pitch of 5 mm, were produced from cylindrical stock tubes of oxygen-free copper 38 mm in outside diameter, 0.4 mm in wall thickness and 80 mm in length.

The hydraulic pressure for bulging was 65 kgf/cm$^2$, the axial load was about 800 kgf, the load for closing the sectional dies was about 2,000 kgf, and the radial load for upsetting was 400 kgf.

When forming was carried out under the abovementioned conditions by the production method and apparatus illustrated in FIGS. 1 to 4, good oval bellows with linear long sides as shown in FIGS. 5 and 6 could be produced.

According to the embodiment described above, the present invention provides the following effects:

(1) Since upsetting dies for pressure application were incorporated in the hydraulic device for producing circular bellows, oval bellows can be produced by a single apparatus.

(2) Oval bellows can be produced by a simple method and at low cost.

According to one aspect of the present invention described above, inexpensive oval bellows can be produced because circular bellows can be radially upset by a simple method and by a part of the apparatus including the hydraulic device for forming circular bellows.

EXAMPLE 2

In accordance with the foregoing the first embodiment, oval bellows in which the major and the minor axes of the oval at the outside of ridges were 17.5 mm and 8 mm, respectively, and the major and the minor axis at the outside of grooves (small diameter portion) were 13.5 mm and 4 mm, respectively, and had a wall thickness between about 0.08 mm and 0.1 mm and five ridges at a pitch of 1 mm were produced from circular copper tubes of 10 mm in outside diameter, 0.1 mm in wall thickness and 30 mm in length under the conditions hydraulic pressure for bulging of 40 kgf/cm$^2$, load for closing sectional dies during bulging of 60 kgf, axial load for folding for producing circular bellows of 30 kgf, and radial upsetting load for ovalizing of 80 kgf.

Two oval bellows thus produced were mounted perpendicular to a substrate for mounting and cooling a LSI chip and parallel to each other. Then, cooling water was introduced into a passage in the cooling substrate through one of the two oval bellows and the water which had passed through the water passage in the cooling substrate was caused to flow out of the other oval bellows. At the same time, the IC chip was elastically or resiliently supported by the two oval bellows through the mounting substrate. As a result, in spite of the amount of heat generated from the IC chip, deformation due to the thermal expansion resulting from heat generation, error in the chip mounting space, etc., the oval bellows could stably support the IC chip for a long time and could hold a temperature increase in the IC chip within a specified range.

Figure 4:
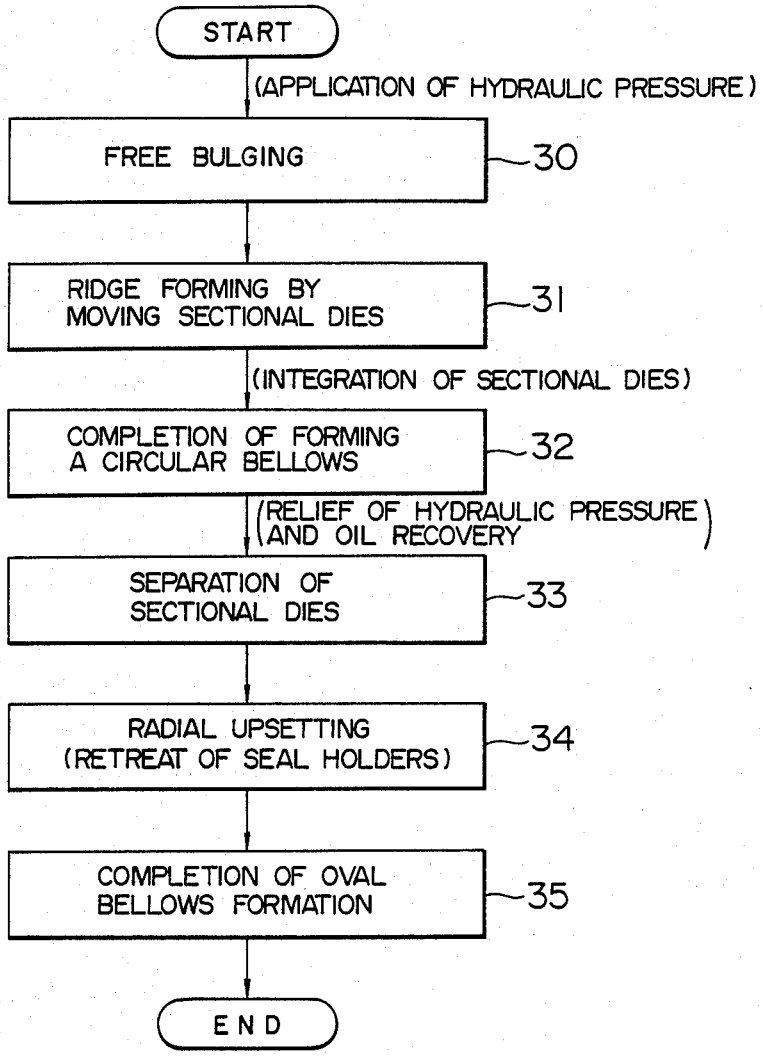
FIG. 4 is a flowchart illustrating the forming process in the first embodiment of the present invention using the apparatus shown in FIGS. 1 to 3.
Figure 7:
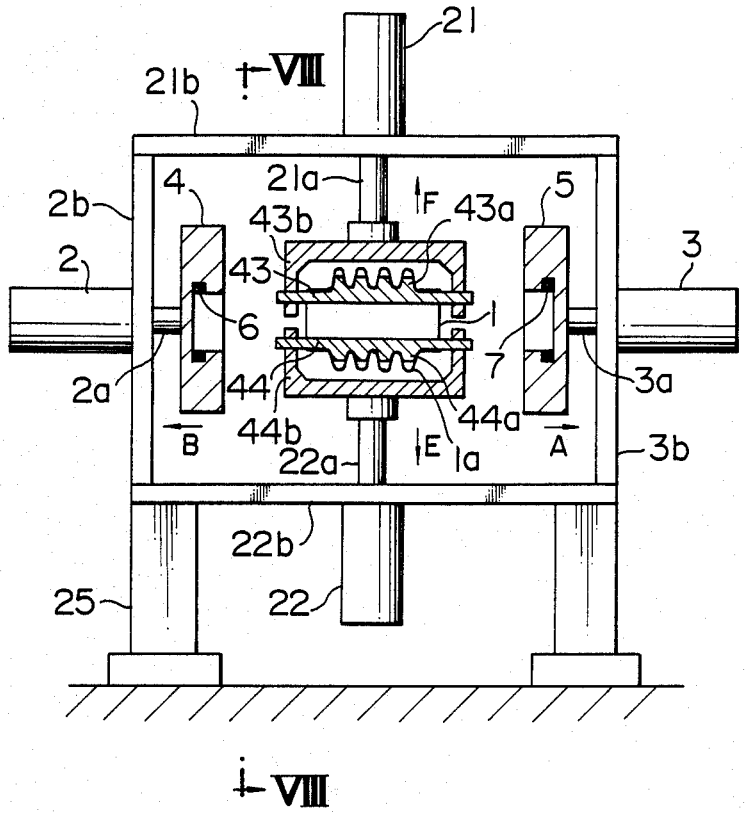
FIG. 7 is a front sectional view of the apparatus of FIG. 1, illustrating an apparatus for carrying out the method for producing the oval bellows in the second preferred embodiment of the present invention in its state of stretching.
Figure 8:
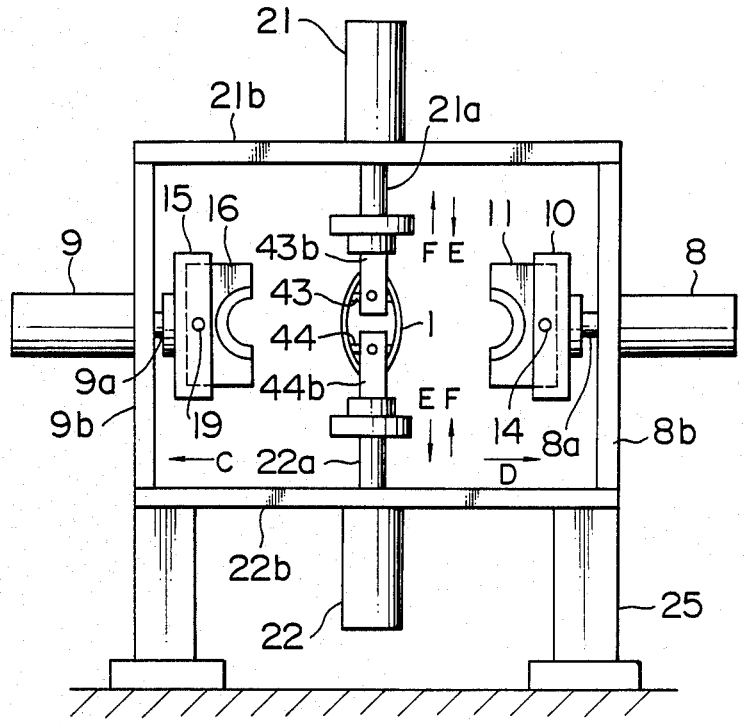
FIG. 8 is a sectional side view along line VIII—VIII of FIG. 7.
Figure 9:
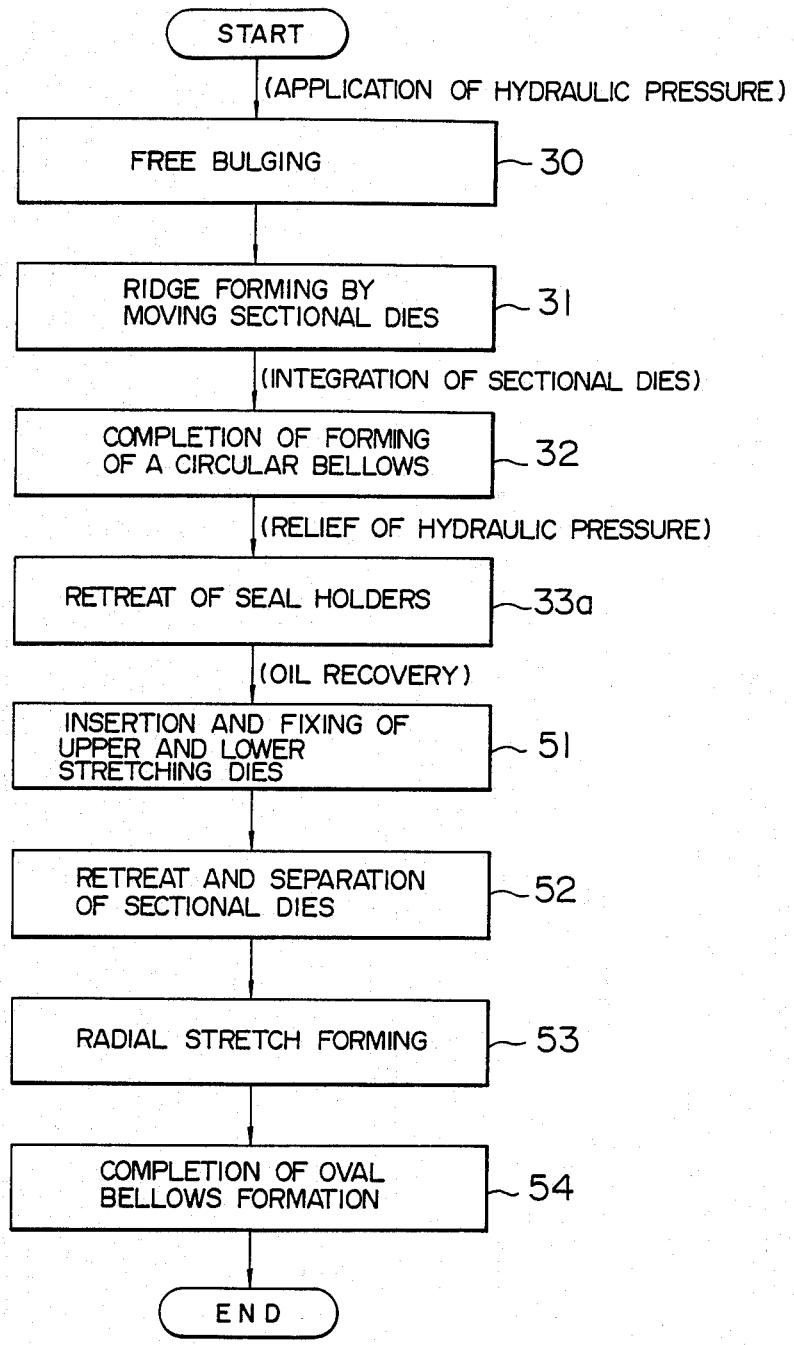
FIG. 9 is a flowchart illustrating the forming process in the second embodiment of the present invention using the apparatus shown in FIGS. 1, 7 and 8.

Instead of conducting upsetting as mentioned above to ovalize a bellows with a circular cross section, stretching may be conducted as will be described hereinafter referring to FIGS. 7 to 9 in addition to FIG. 1. In FIGS. 7 to 9, members and elements similar to those in FIGS. 2 to 4 are designated by the same reference numerals or characters as used in FIGS. 2 and 4.

In FIGS. 7 and 8 illustrating an apparatus for producing an oval bellows according to the second embodiment of the present invention, an upper stretching die 43 and a lower stretching die 44 having the same configuration with each other are used for producing a bellows with an oval cross section, from a circular bellows hydraulically formed by means of the first to sixth sectional dies 11–13 and 16–18, by performing stretch forming. The stretch forming or stretching is accomplished with tensile loads applied in the radial directions F and E by moving the upper and lower stretching dies in the directions F and E, respectively, thereby causing the two to be spaced from each other, through the actuation of the fifth and sixth cylinders 21, 22. Incidentally, the deformation of a ridges 1*a* of the circular bellows can be prevented by fitting into the ridges la and groove of the circular bellows 1*d*, corrugations 43*a* and 44*a* of the dies 43, 44 having the same outside configuration as the inside configuration of an oval bellows at ends of the major axis of the oval. The upper and lower stretching dies 43 and 44 are detachably fixed, through supporting members 43*b* and 44*b*, respectively, to the rods 21*a* and 22*a* of the fifth and sixth cylinders 21 and 22, respectively, arranged in perpendicular to the third and fourth cylinders 8, 9. The fifth and sixth cylinders 21 and 22 are fixed to mounting plates 21*b* and 22*b*, respectively.

The operation of an apparatus thus constructed for carrying out the method for producing bellows in the second embodiment of the present invention is explained hereinafter.

The circular bellows is first formed in the same manner as in the first embodiment with reference to FIGS. 1 to 4.

In the present case, however, after the completion of the forming of a circular bellows (after the step 32) the hydraulic pressure 20 is first relieved and the seal holders 4 and 5 are then caused to retreat (the step 33*a* in FIG. 9), unlike the first embodiment, to recover the oil.

As shown in FIGS. 7 and 8, the upper and lower stretching dies 43 and 44 are then introduced into the circular bellows and the convex parts 43*a* and 44*a* of corrugations of the upper and lower stretching dies 43 and 44 are placed in the inside of the ridges 1*a* of this circular bellows. The rods 21*a* and 22*a* are then advanced in the directions E and F, respectively, by actuating the fifth and sixth cylinders 21 and 22, and the upper and lower stretching dies 43 and 44 are fixed to the supporting members 43*b* and 44*b* at the ends of the rods 21*a* and 22*a* respectively (the step 51 in FIG. 9). Next, the sectional dies 11–13 and 16–18 are separated from the circular bellows by causing the rods 8*a* and 9*a* to retreat in the directions D and C (the step 52 in FIG. 9). After that, the rods 21*a* and 22*a* of the cylinders 21 and 22 are caused to retreat by a specified distance in the directions F and E, respectively, and stretch forming is conducted by axially applying tensile loads to the circular bellows in order to cause the circular bellows to undergo plastic deformation, whereby the desired oval bellows 26 as shown in FIGS. 5 and 6 can be produced (the steps 53 and 54).

The manufacturing process of bellows in the second embodiment is schematically shown in FIG. 9.

Now an example of the second embodiment is described.

EXAMPLE 3

Oval bellows in which the major axis of an oval at the outside of ridges was about 70 mm (47 mm at the outside of grooves) and the minor axis of the oval at the outside of ridges is about 45 mm (22 mm at the outside of grooves) and which have four ridges at a pitch of 5 mm, were produced from cylindrical stock tubes of phosphor bronze 38 mm in outside diameter, 0.4 mm in wall thickness and 80 mm in length by means of the apparatus of the second embodiment shown in FIGS. 1, 7 and 8 according to the procedure shown in FIG. 9.

The hydraulic pressure for bulging was set at 85 kgf/cm$^2$, the axial loads in the directions A and B at about 2,500 kgf, the closing loads for sectional dies in the directions C and D at about 3,000 kgf, the radial stretching load of about 2,000 kgf, and the retreat distance of upper and lower stretching dies in the directions F and E at 4.5 mm. Under these conditions, a circular bellows of 38 mm in diameter at the grooves and 61 mm in diameter at the ridges and with a pitch of 5 mm was first formed and the circular bellows was then formed to produce an oval bellows. As a result, an oval bellows 26 of the desired size and good shape could be produced.

Incidentally, the retreat distances of the upper and lower stretching dies may be different from each other, or one of the upper and lower stretching dies may be retreated by a desired retreat distance.

According to the second embodiment, the present invention provides the following effects:

(1) Costs can be reduced because oval bellows 26 can be produced from inexpensive circular (cylindrical) stock tubes 1.

(2) Oval bellows can be produced by means of the same apparatus as used for the forming of circular bellows by installing the upper and lower stretching dies 43 and 44 on the hydraulic forming device.

(3) Buckling, wrinkling, etc., do not occur during forming because the deformation by stretching is the principal step of this forming method.

(4) Because the passage area in the interior of a formed article (oval bellows) does not decrease.

(5) The ratio of the length of the major axis of the oval to the length of the minor axis thereof can be changed by changing the retreat distance of the upper and lower stretching dies.

According to another aspect of the present invention, cost reductions can be accomplished because oval bellows can be produced from inexpensive circular tubes as the stock. In addition, the oval bellows can be produced by means of the same apparatus as the hydraulic device for forming the circular bellows. Moreover, irregular deformation, such as buckling and wrinkling, is not apt to occur and few defective parts are produced. There is an additional effect that the passage area does not decrease.

What is claimed is:

1. A method for producing a bellows with an oval cross section comprising the steps of bulging a metallic cylindrical tube to form a bellows with a circular cross section and ovalizing the bellows with the circular cross section to form the bellows with the oval cross section, said ovalizing step comprising an upsetting of the bellows with the circular cross section by using a pair of dies for applying upsetting forces to the circular bellows in a radial direction of the bellows, and applying hydraulic pressure inside of the circular bellows during said upsetting.

2. A method as claimed in claim 1, wherein the bulging is conducted by applying fluid pressure to an inside of the cylindrical tube.

3. A method as claimed in claim 2, wherein the fluid for pressure application is a liquid.

4. A method as claimed in claim 1, wherein said step of forming the circular bellows includes a step of axially deforming a bulged metallic tube under pressing pressure so that bulged portions of the tube are folded.

5. A method as claimed in claim 1, wherein said step of forming the bellows with the circular cross section comprises placing two sets of sectional half-dies, which cooperatively define a circular shape by inside surfaces thereof, each set consisting of halves of sectional dies, to an outside of the metallic cylindrical tube in a manner that the sectional dies in each set are spaced by a specified distance from each other in the axial direction of the tube, bulging the metallic cylindrical tube by applying hydraulic pressure to an inside of said metallic tube, and axially pressing the metallic tube to form the bellows with the circular cross section.

6. A method as claimed in claim 5, wherein the circular bellows is formed by means of a bulge forming die, which comprises the two sets of sectional dies, each of sectional die comprising a forming part which has an inside diameter almost equal to an outside diameter of the cylindrical tube and a same shape of inside surface as one of the grooves of the circular bellows to be formed, and a base integrated with the forming part and of larger thickness than the forming part, each set of sectional half-die being superposed on each other so that the thickness center distance of the forming parts becomes equal to the pitch of the bellows with the circular cross section.

7. A method as claimed in claim I, wherein ovalizing is conducted by means of stretching dies which have a same external form as an internal form at ends on the major axis of the oval of the bellows with the oval cross section to be formed and provide corrugations capable of being fitted to ridges and grooves of the bellows with the circular cross section.

8. An apparatus for producing a bellows with an oval cross section which comprises a frame; a first supporting mechanism having a pair of first supporting parts, the first supporting mechanism being mounted on the frame in such a manner that the pair of first supporting parts are opposed to each other in a first direction and are capable of approaching each other and moving away from each other so as to be able to support both ends of a metallic tubular body in a liquid-tight manner; a second supporting mechanism having a pair of second supporting parts, the second supporting mechanism being mounted on the frame in such a manner that the pair of second supporting parts are capable of approaching each other and moving away from each other in a second direction orthogonal to the first direction; two sets of sectional dies supported by the second supporting parts so that the sectional dies can be brought into contact with opposed side walls of the metallic tube when the second supporting parts are moved so as to approach each other; a hydraulic pressure introducing means for introducing hydraulic pressure into the metallic tube through at least one of the first supporting parts to conduct bulging of the metallic cylindrical tube while both ends of the metallic cylindrical tube are supported by the first supporting parts in the liquid-tight manner and the opposed side walls of the metallic cylindrical tube are kept in contact with the two sets of sectional dies, the sectional dies in each set being kept away from each other in the first direction; and a third supporting mechanism having a pair of third supporting parts, the third supporting mechanism being mounted on the frame in such a manner that the pair of third supporting parts are capable of approaching each other and moving away from each other in the third direction orthogonal to the first and second directions and adapted to ensure that the cross-sectional shape of a bellow with circular shape formed by the bulging is changed into a bellows with an oval shape by deforming opposed side walls of the bellows when the third supporting parts are caused to approach each other, the third supporting parts of the third supporting mechanism having upsetting parts adapted to change the cross-sectional shape of the bellows from the circular shape into a oval shape by applying upsetting forces to the opposed side walls of the bellows when the third supporting parts are caused to approach each other;

wherein the first supporting parts are operative to support both ends of the circular bellows in the liquid-tight manner during the upsetting by the upsetting parts and hydraulic pressure is applied to the inside of the circular bellows by means of the hydraulic pressure introducing mechanism during the upsetting.

9. An apparatus as claimed in claim 8, wherein each set of the sectional dies are supported by each of the second supporting parts in a manner that each set of the sectional dies can be moved relative to the corresponding second supporting part and relative to each other in said first direction, and the first supporting mechanism is adapted to press both ends of the metallic tube by means of the first supporting parts so that after the bulging the first supporting parts are caused to approach each other closer than during the bulging.

10. An apparatus as claimed in claim 8, wherein each of the upsetting parts provides concavities receiving protrusions of the circular bellows in an area where it is brought into contact with the opposed side wall of the bellows.

11. An apparatus as claimed in claim 8, wherein each of the first, second and third supporting mechanisms proper comprises a cylinder means.

12. An apparatus as claimed in claim 8, wherein said third direction is vertical direction.

* * * * *